US007642984B2

(12) United States Patent
Tsai et al.

(10) Patent No.: US 7,642,984 B2
(45) Date of Patent: Jan. 5, 2010

(54) ANTENNA FOR A WIRELESS PERSONAL AREA NETWORK

(75) Inventors: Tiao-Hsing Tsai, Yungho (TW); Chao-Hsu Wu, Tao Yuan Shien (TW); Chi-Yin Fang, Pingtung (TW)

(73) Assignee: Quanta Computer Inc. (TW)

( * ) Notice: Subject to any disclaimer, the term of this patent is extended or adjusted under 35 U.S.C. 154(b) by 35 days.

(21) Appl. No.: 12/169,362

(22) Filed: Jul. 8, 2008

(65) Prior Publication Data

US 2009/0195466 A1 Aug. 6, 2009

(30) Foreign Application Priority Data

Feb. 4, 2008 (TW) ..... 97104200 A

(51) Int. Cl.
*H01Q 1/36* (2006.01)

(52) U.S. Cl. ..... 343/828; 343/702; 343/741

(58) Field of Classification Search ..... 343/700 MS, 343/702, 741, 828–830, 846
See application file for complete search history.

(56) References Cited

U.S. PATENT DOCUMENTS

| | | | | |
|---|---|---|---|---|
| 6,734,820 | B2 * | 5/2004 | Hager et al. | 342/194 |
| 6,801,169 | B1 * | 10/2004 | Chang et al. | 343/700 MS |
| 6,864,841 | B2 * | 3/2005 | Dai et al. | 343/700 MS |
| 6,864,854 | B2 * | 3/2005 | Dai et al. | 343/846 |
| 6,985,114 | B2 * | 1/2006 | Egashira | 343/702 |

* cited by examiner

*Primary Examiner*—Michael C Wimer
(74) *Attorney, Agent, or Firm*—Sunstein Kann Murphy & Timbers LLP

(57) ABSTRACT

An antenna includes a loop radiating element, and first and second radiating arms. The loop radiating element includes first and second segments, each of which has opposite first and second ends, and an intermediate segment that interconnects the second ends of the first and second segments thereof. The first and second radiating arms extend outwardly and respectively from the first and second ends of the first segment of the loop radiating element.

17 Claims, 8 Drawing Sheets

H plane (X-Y plane, $\theta$=90)

Peak = -2.68 dBi, Avg. = -4.64 dBi.

E1 plane (X-Z plane, ø=0)

Peak = 0.42 dBi, Avg. = -4.06 dBi.

E2 plane (Y-Z plane, ø=90)

Peak = -0.35 dBi, Avg. = -4.22 dBi.

Peak = 3.15 dBi, Avg. = -2.79 dBi.

Peak = 1.32 dBi, Avg. = -3.36 dBi.

Peak = 1.14 dBi, Avg. = -3.96dBi.

Peak = 0.65 dBi, Avg. = -3.66dBi.

Peak = 0 dBi, Avg. = -2.58 dBi.

Peak = 0.65 dBi, Avg. = -2.48 dBi.

ANTENNA FOR A WIRELESS PERSONAL AREA NETWORK

CROSS-REFERENCE TO RELATED APPLICATION

This application claims priority of Taiwanese application no. 097104200, filed on Feb. 4, 2008.

BACKGROUND OF THE INVENTION

1. Field of the Invention

This invention relates to an antenna, more particularly to antenna that is applicable to a wireless personal area network (WPAN).

2. Description of the Related Art

A conventional planar inverted-F antenna (PIFA), which is applicable to a wireless personal area network (WPAN), includes a coupling element, such as a parasitic coupling element, and is operable in a Bluetooth frequency range from 2402 MHz to 2480 MHz, and an ultra-wideband (UWB) Band I frequency range from 3168 MHz to 4752 MHz.

The aforementioned conventional PIFA is disadvantageous in that it has relatively large physical size, narrow bandwidth, and complicated structure, and is difficult to control so as to enable operation thereof in the Bluetooth frequency range and the UWB Band I frequency range.

SUMMARY OF THE INVENTION

Therefore, the object of the present invention is to provide an antenna that can overcome the aforesaid drawbacks of the prior art.

According to the present invention, an antenna comprises a loop radiating element, and first and second radiating arms. The loop radiating element includes first and second segments, and an intermediate segment. Each of the first and second segments has opposite first and second ends. The first ends of the first and second segments are adapted to be coupled respectively to positive and negative terminals of a coaxial cable. The intermediate segment interconnects the second ends of the first and second segments, and cooperates with the first segment to define a first corner therebetween and the second segment to define a second corner therebetween. The first segment further has a side that extends between the first and second ends thereof. The first and second radiating arms extend outwardly and respectively from the first and second ends of the first segment of the loop radiating element and are disposed at the side of the first segment of the loop radiating element.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
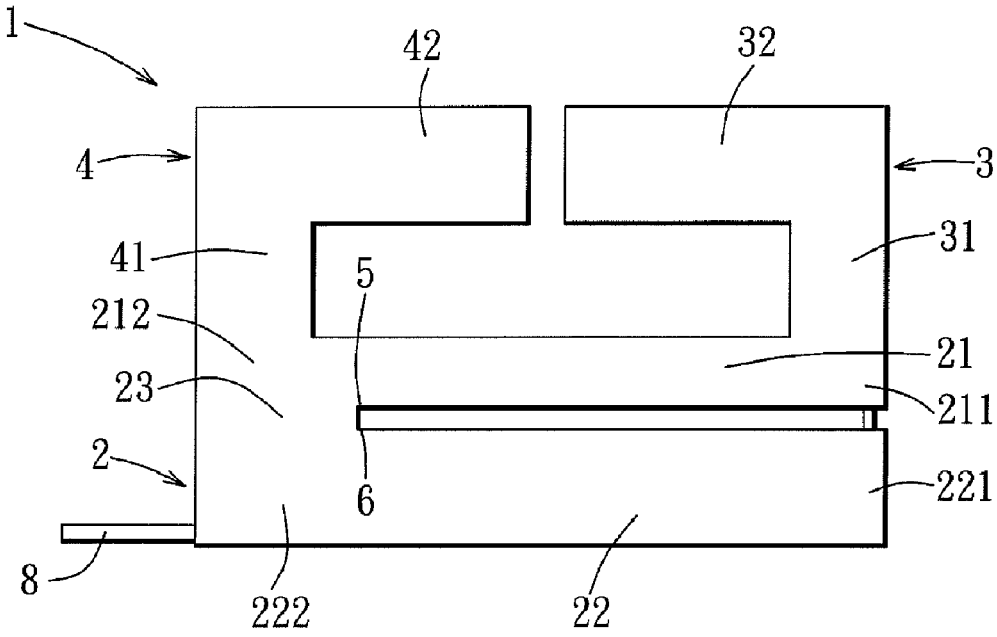
FIG. 1 is a schematic view of the preferred embodiment of an antenna according to this invention.

Referring to FIG. 1, the preferred embodiment of an antenna 1 according to this invention is shown to include a loop radiating element 2, and first and second radiating arms 3, 4.

Figure 2:
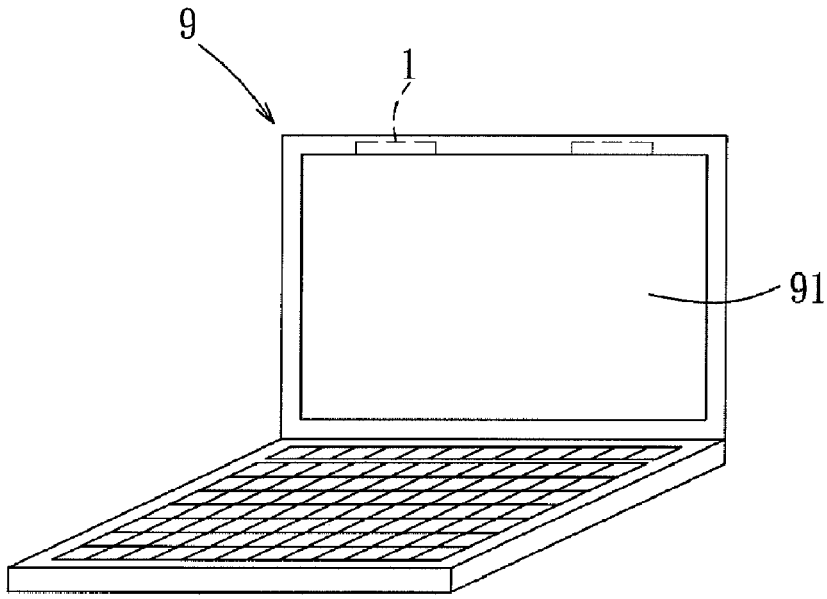
FIG. 2 is a perspective view illustrating an exemplary application in which the preferred embodiment is installed in a notebook computer.

The antenna 1 of this invention, as illustrated in FIG. 2, is installed in an electronic device 9, such as a notebook computer, is disposed above a display 91 of the electronic device 9, is applicable to a wireless personal area network (WPAN), and is operable in a Bluetooth frequency range from 2402 MHz to 2480 MHz, and an ultra-wideband (UWB) Band I frequency range from 3168 MHz to 4752 MHz.

The loop radiating element 2 operates in a first frequency range, and cooperates with the first radiating arm 3 to operate in a second frequency range adjacent to the first frequency range. In this embodiment, the first and second frequency ranges cover frequencies in the UWB Band I frequency range. Furthermore, the loop radiating element 2 cooperates with the second radiating arm 4 to operate in a third frequency range lower than the first and second frequency ranges. In this embodiment, the third frequency range covers frequencies in the Bluetooth frequency range.

Figure 3:
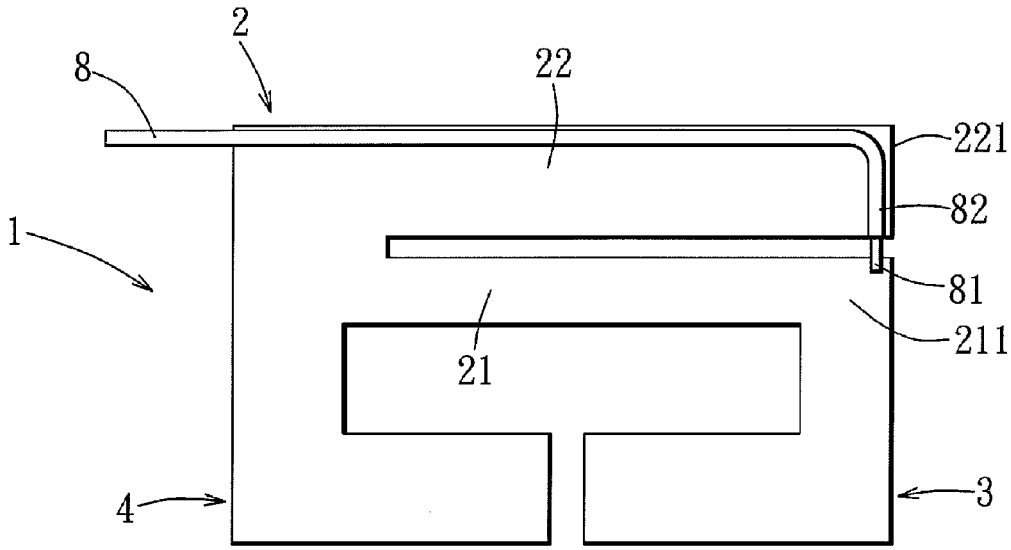
FIG. 3 is a schematic view illustrating an exemplary connecting configuration in which the preferred embodiment is connected to a coaxial cable.
Figure 4:
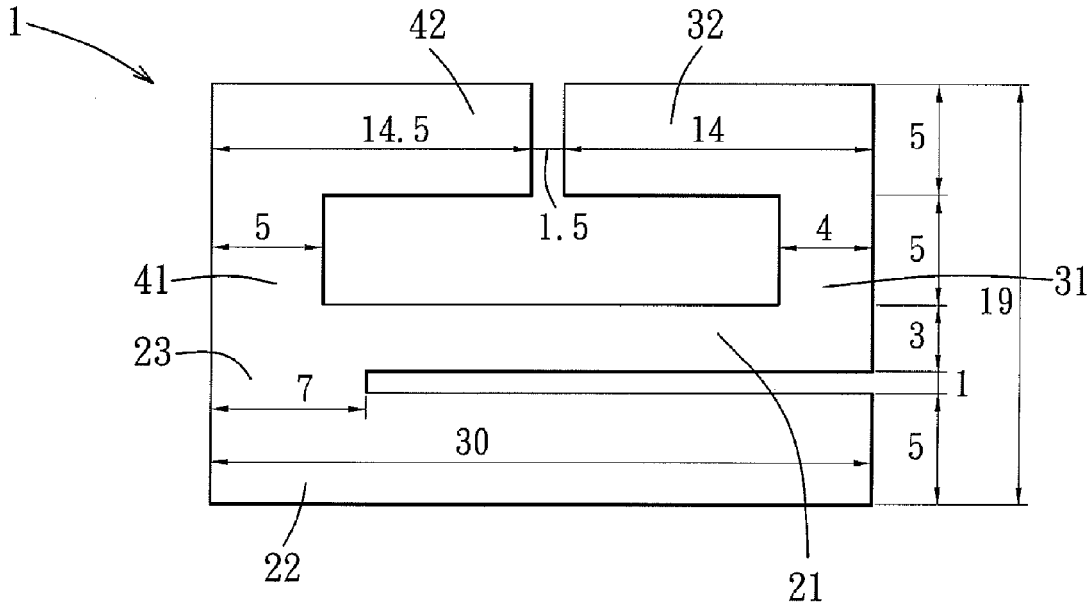
FIG. 4 is a schematic view illustrating dimensions of the preferred embodiment.

The loop radiating element 2 includes first and second segments 21, 22, and an intermediate segment 23. Each of the first and second segments 21, 22 of the loop radiating element 2 has opposite first and second ends 211, 221, 212, 222. In this embodiment, the first ends 211, 221 of the first and second segments 21, 22 of the loop radiating element 2, as illustrated in FIG. 3, are coupled respectively to positive and negative terminals 81, 82 of a coaxial cable 8. The intermediate segment 23 of the loop radiating element 2 interconnects the second ends 212, 222 of the first and second segments 21, 22 of the loop radiating element 2, and cooperates with the first segment 21 of the loop radiating element 2 to define a first corner 5 therebetween and the second segment 22 of the loop radiating element 2 to define a second corner 6 therebetween. In this embodiment, the first segment 21 is parallel to the second segment 22 and is transverse to the intermediate segment 23. Preferably, with further reference to FIG. 4, the first segment 21 of the loop radiating element 2 has a length of 30 millimeters and a width of 3 millimeters, the second segment 22 of the loop radiating element 2 has a length of 30 millimeters and a width of 5 millimeters, and the intermediate segment 23 of the loop radiating element 2 has a length of 1 millimeter and a width of 7 millimeters.

The first radiating arm 3 extends outwardly from the first end 211 of the first segment 21 of the loop radiating element 2. In this embodiment, the first radiating arm 3 includes first and second segments 31, 32. The first segment 31 of the first radiating arm 3 extends transversely to the first segment 21 of the loop radiating element 2, and has a first end connected to the first end 211 of the first segment 21 of the loop radiating element 2, and a second end opposite to the first end thereof. The second segment 32 of the first radiating arm 3 extends transversely to the first segment 31 of the first radiating arm 3, and has an end connected to the second end of the first segment 31 of the first radiating arm 3. Preferably, with further reference to FIG. 4, the first segment 31 of the first radiating arm 3 has a length of 5 millimeters and a width of 4 millimeters, and the second segment 32 of the first radiating arm 3 has a length of 14 millimeters and a width of 5 millimeters.

The second radiating arm 4 extends outwardly from the second end 212 of the first segment 21 of the loop radiating element 2. In this embodiment, the second radiating arm 4 includes first and second segments 41, 42. The first segment 41 of the second radiating arm 4 extends transversely to the first segment 21 of the loop radiating element 2, and has a first end connected to the second end 212 of the first segment 21 of the loop radiating element 2, and a second end opposite to the first end thereof. The second segment 42 of the second radiating arm 4 extends transversely to the first segment 41 of the second radiating arm 4, and has an end connected to the second end of the first segment 41 of the second radiating arm 4. Preferably, with further reference to FIG. 4, the first segment 41 of the second radiating arm 4 has a length of 5 millimeters and a width of 5 millimeters, and the second segment 42 of the second radiating arm 4 has a length of 14.5 millimeters and a width of 5 millimeters.

It is noted that, in this embodiment, the first and second radiating arms 3, 4 are disposed at a side of the first segment 21 of the loop radiating element 2 that extends between the first and second ends 211, 212 of the first segment 21 of the loop radiating element 2. Moreover, in this embodiment, the second segments 32, 42 of the first and second radiating arms 3, 4 extend toward each other. Preferably, with further reference to FIG. 4, the second segments 32, 42 of the first and second radiating arms 3, 4 define a distance therebetween of 1.5 millimeters.

Figure 5:
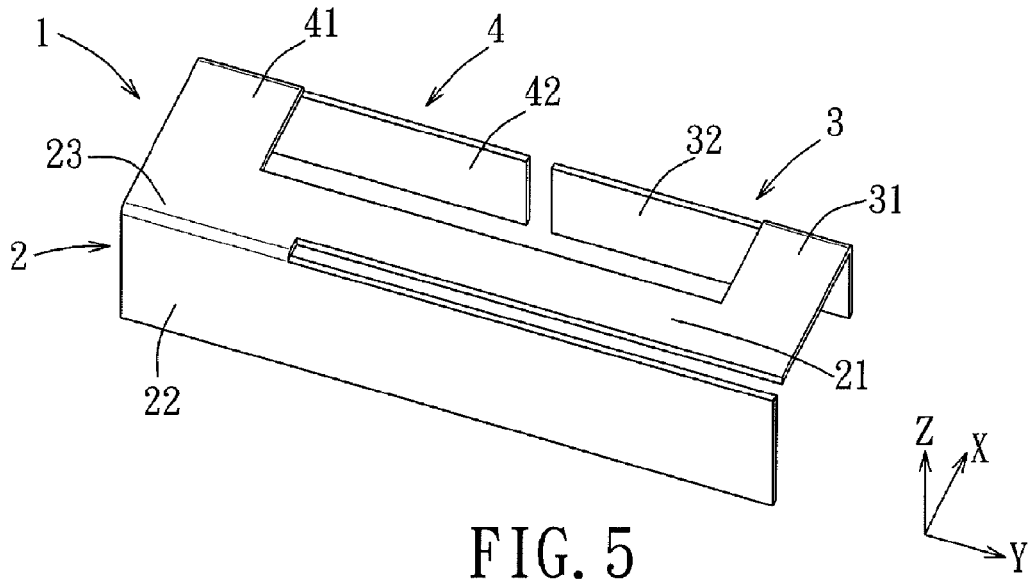
FIG. 5 is a perspective view illustrating a folded state of the preferred embodiment.

With further reference to FIG. 5, the antenna 1 of this invention may be folded such that the first segment 21 of the loop radiating element 2 and the first segments 31, 41 of the first and second radiating arms 3, 4 are coplanar in a first plane, i.e., the x-y plane, the second segment 22 of the loop radiating element 2 lies in a second plane, i.e., the y-z plane, transverse to the first plane, and the second segments 32, 42 of the first and second radiating arms 3, 4 are coplanar in a third plane parallel to the second plane. The construction as such reduces the physical size of the antenna 1 of this invention.

It is noted that the dimensions of the first, second, and intermediate segments 21, 22, 23 of the loop radiating element 2, the first and second segments 31, 32 of the first radiating arm 3, and the first and second segments 41, 42 of the second radiating arm 4 may be adjusted to permit operation of the antenna 1 of this invention in the UWB Band I and the Bluetooth frequency ranges.

Figure 6:
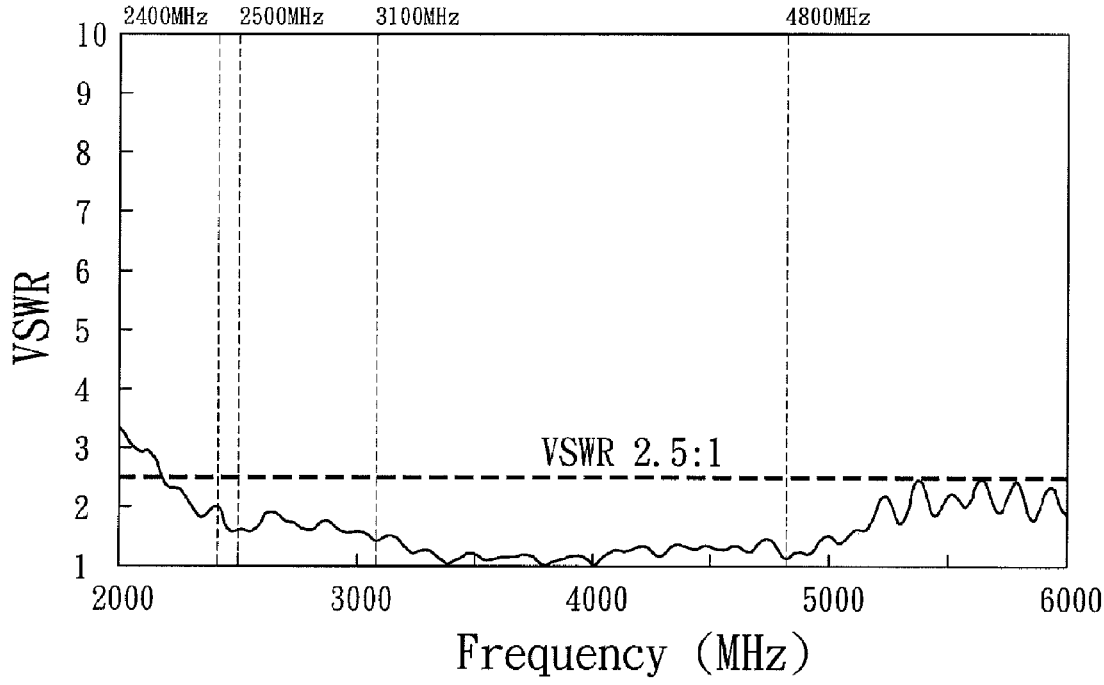
FIG. 6 is a plot illustrating a voltage standing wave ratio (VSWR) of the preferred embodiment.
Figure 7:
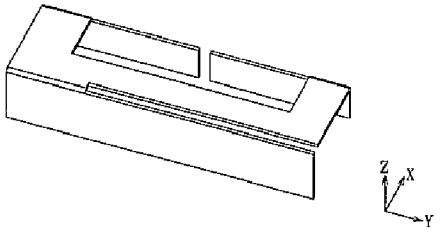
FIG. 7 shows plots of radiation patterns of the preferred embodiment respectively on the x-y, x-z, and y-z planes when operated at 2440 MHz.
Figure 7:
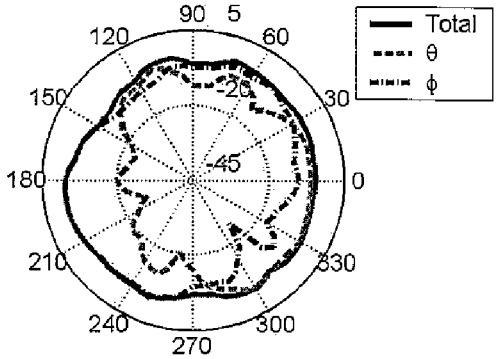
Figure 7:
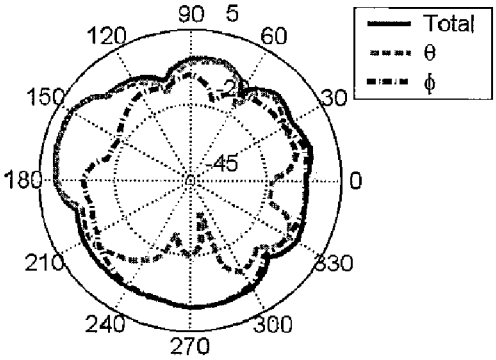
Figure 7:
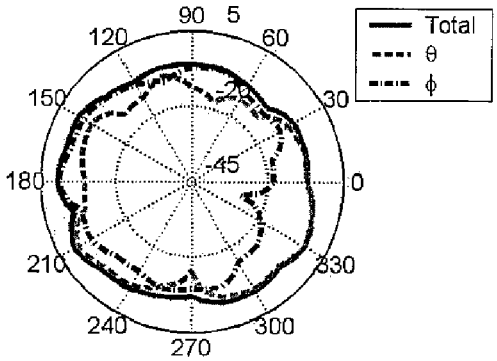
Figure 8:
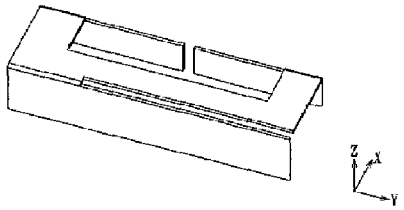
FIG. 8 shows plots of radiation patterns of the preferred embodiment respectively on the x-y, x-z, and y-z planes when operated at 3168 MHz.
Figure 8:
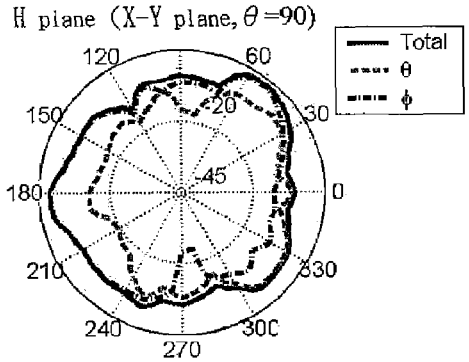
Figure 8:
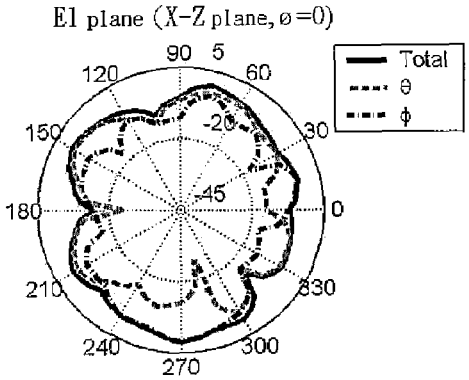
Figure 8:
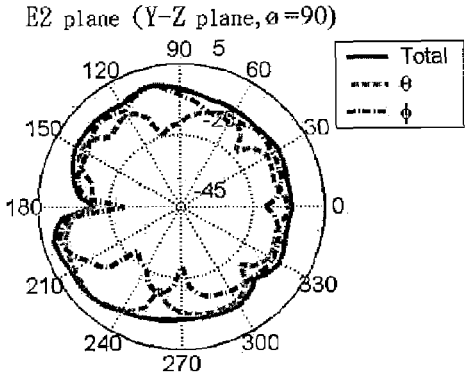
Figure 9:
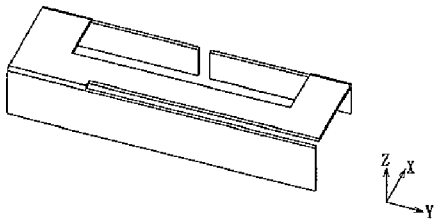
FIG. 9 shows plots of radiation patterns of the preferred embodiment respectively on the x-y, x-z, and y-z planes when operated at 3960 MHz.
Figure 9:
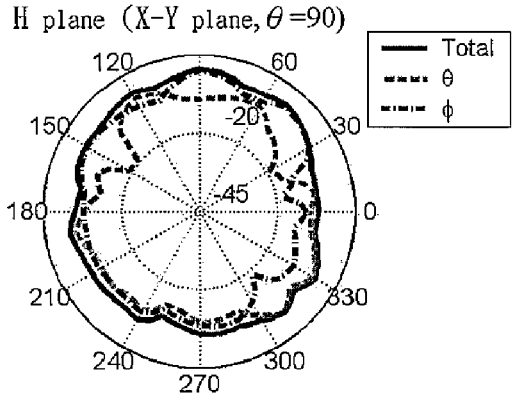
Figure 9:
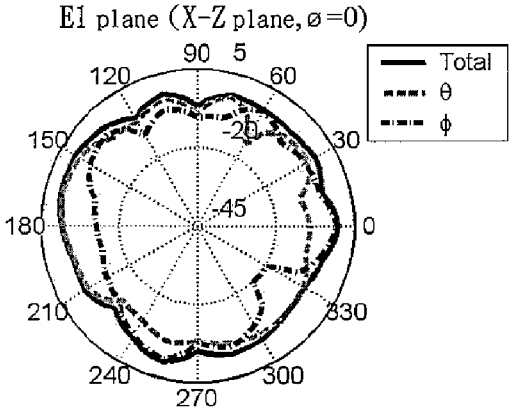
Figure 9:
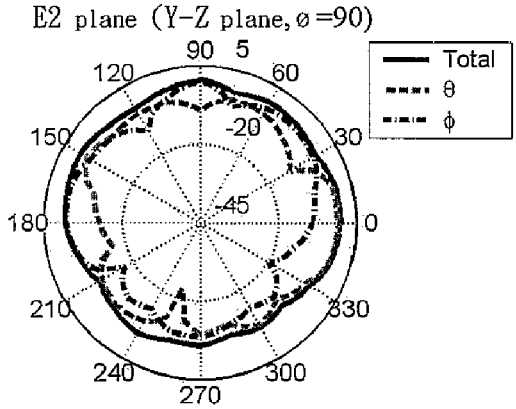
Figure 10:
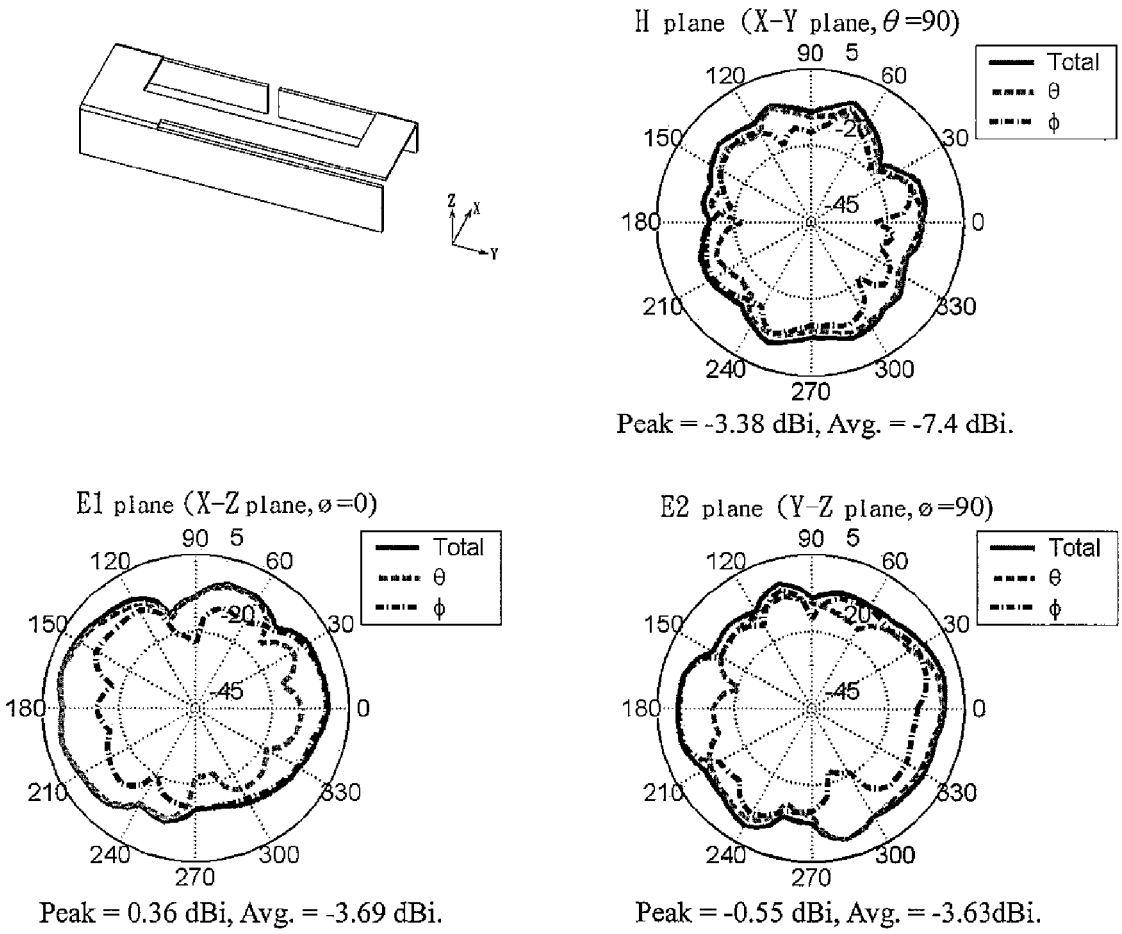
FIG. 10 shows plots of radiation patterns of the preferred embodiment respectively on the x-y, x-z, and y-z planes when operated at 4752 MHz.

Experimental results, as illustrated in FIG. 6, show that the antenna I of this invention achieves a voltage standing wave ratio (VSWR) of less than 2.5 when operated in each of the UWB Band I and the Bluetooth frequency ranges. Moreover, as shown in Table I, the antenna 1 of this invention achieves a maximum total radiation power (TRP) of −2.8 dB and a maximum efficiency of 52.6%. Further, as illustrated in FIGS. 7 to 10, the antenna 1 of this invention has substantially omnidirectional radiation patterns when operated at 2440 MHz, 3168 MHz, 3960 MHz, and 4752 MHz, respectively.

Figure 11:
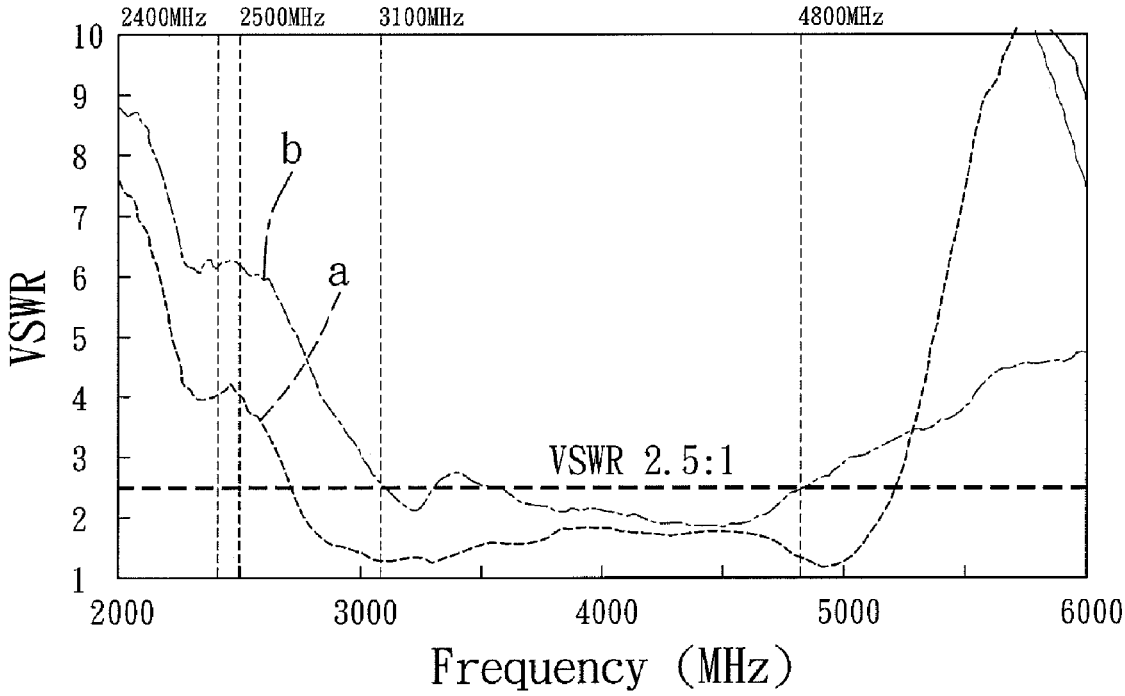
FIG. 11 shows plots illustrating VSWRs when both first and second radiating arms or only the second radiating arm of the preferred embodiment are/is removed.

It is noted that, as illustrated in FIG. 11, when the second radiating arm 4 of the antenna 1 of this invention is removed, as indicated by line (a), a desirable VSWR of less than 2.5 is achieved in the UWB Band I frequency range but an undesirable VSWR of greater than 2.5 results in the Bluetooth frequency range. On the other hand, when the first and second radiating arms 3, 4 of the antenna 1 of this invention are removed, as indicated by line (b), an undesirable VSWR of greater than 2.5 results in each of the UWB Band I and the Bluetooth frequency ranges.

TABLE I

| Frequency (MHz) | TRP (dB) | Efficiency (%) |
|---|---|---|
| 2402 | −5.2 | 30.2 |
| 2440 | −4.2 | 37.6 |
| 2480 | −4.4 | 36.4 |
| 3168 | −3.2 | 48.1 |
| 3432 | −3.2 | 48.2 |
| 3696 | −3.1 | 48.5 |
| 3960 | −2.8 | 52.6 |
| 4224 | −3.3 | 47.3 |
| 4488 | −4.0 | 39.7 |
| 4752 | −4.4 | 36.0 |

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An antenna comprising:

a loop radiating element including first and second segments, each of which has opposite first and second ends, said first ends of said first and second segments being adapted to be coupled respectively to positive and negative terminals of a coaxial cable, and an intermediate segment that interconnects said second ends of said first and second segments, and that cooperates with said first segment to define a first corner therebetween and said second segment to define a second corner therebetween, said first segment further having a side that extends between said first and second ends thereof; and first and second radiating arms extending outwardly and respectively from said first and second ends of said first segment of said loop radiating element and disposed at said side of said first segment of said loop radiating element.

2. The antenna as claimed in claim 1, wherein said first segment is parallel to said second segment and is transverse to said intermediate segment.

3. The antenna as claimed in claim 2, wherein said first radiating arm includes a first segment that extends transversely to said first segment of said loop radiating element, said first segment of said first radiating arm having a first end connected to said first end of said first segment of said loop radiating element, and a second end opposite to said first end thereof, and a second segment that extends transversely to said first segment of said first radiating arm, said second segment of said first radiating arm having an end connected to said second end of said first segment of said first radiating arm.

4. The antenna as claimed in claim 3, wherein said second segment of said first radiating arm extends toward said second radiating arm.

5. The antenna as claimed in claim 2, wherein said second radiating arm includes a first segment that extends transversely to said first segment of said loop radiating element, said first segment of said second radiating arm having a first end connected to said second end of said first segment of said loop radiating element, and a second end opposite to said first end thereof, and a second segment that extends transversely to said first segment of said second radiating arm, said second segment of said second radiating arm having an end connected to said second end of said first segment of said second radiating arm.

6. The antenna as claimed in claim 5, wherein said second segment of said second radiating arm extends toward said first radiating arm.

7. The antenna as claimed in claim 3, wherein said second radiating arm includes a first segment that extends transversely to said first segment of said loop radiating element, said first segment of said second radiating arm having a first end connected to said second end of said first segment of said loop radiating element, and a second end opposite to said first end thereof, and a second segment that extends transversely to said first segment of said second radiating arm, said second segment of said second radiating arm having an end connected to said second end of said first segment of said second radiating arm.

8. The antenna as claimed in claim 7, wherein said second segments of said first and second radiating arms extend toward each other.

9. The antenna as claimed in claim 7, wherein said first segment of said loop radiating element and said first segments of said first and second radiating arms are coplanar in a first plane, said second segment of said loop radiating element lies in a second plane transverse to the first plane, and said second segments of said first and second radiating arms are coplanar in a third plane parallel to the second plane.

10. The antenna as claimed in claim 1, wherein said loop radiating element operates in a first frequency range, and cooperates with said first radiating arm to operate in a second frequency range adjacent to the first frequency range.

11. The antenna as claimed in claim 10, wherein the first and second frequency ranges cover frequencies from 3168 MHz to 4752 MHz.

12. The antenna as claimed in claim 10, wherein said loop radiating element cooperates with said second radiating arm to operate in a third frequency range lower than the first and second frequency ranges.

13. The antenna as claimed in claim 12, wherein the third frequency range covers frequencies from 2402 MHz to 2480 MHz.

14. The antenna as claimed in claim 8, wherein said second segments of said first and second radiating arms define a distance therebetween of 1.5 millimeters.

15. The antenna as claimed in claim 1, wherein said first segment of said loop radiating element has a length of 30 millimeters and a width of 3 millimeters, said second segment of said loop radiating element has a length of 30 millimeters and a width of 5 millimeters, and said intermediate segment of said loop radiating element has length of 1 millimeter and a width of 7 millimeters.

16. The antenna as claimed in claim 4, wherein said first segment of said first radiating arm has a length of 5 millimeters and a width of 4 millimeters, and said second segment of said first radiating element has a length of 14 millimeters and a width of 5 millimeters.

17. The antenna as claimed in claim 6, wherein said first segment of said second radiating arm has a length of 5 millimeters and a width of 5 millimeters, and said second segment of said second radiating arm has a length of 14.5 millimeters and a width of 5 millimeters.

* * * * *